United States Patent [19]

Sommers-Szoszky

[11] 4,387,522

[45] Jun. 14, 1983

[54] INTERCHANGEABLE ILLUMINATED SIGN

[76] Inventor: Paul Sommers-Szoszky, 3002-3 Meadowbrook, Windsor, Ontario N8T 3G8, Canada

[21] Appl. No.: 370,104

[22] Filed: Apr. 20, 1982

Related U.S. Application Data

[63] Continuation of Ser. No. 188,310, Sep. 18, 1980, abandoned.

[51] Int. Cl.[3] ..... G09F 13/04

[52] U.S. Cl. ..... 40/576; 40/574

[58] Field of Search ..... 40/576, 580, 579, 575, 40/574

[56] References Cited

U.S. PATENT DOCUMENTS

| | | | |
|---|---|---|---|
| 931,188 | 8/1909 | Ellis | 40/580 X |
| 1,271,044 | 7/1918 | Leech | 40/576 |
| 1,519,791 | 12/1924 | Manville | 40/576 |
| 1,652,477 | 12/1927 | Hall | 40/580 |
| 1,786,155 | 12/1930 | Farrell | 40/580 |
| 1,975,690 | 10/1934 | Harrington et al. | 40/580 |
| 2,632,270 | 3/1953 | Moss | 40/576 X |
| 2,707,346 | 5/1955 | Fuller | 40/580 |
| 3,742,633 | 7/1973 | Palm | 40/576 |

*Primary Examiner*—Gene Mancene
*Assistant Examiner*—Michael J. Foycik
*Attorney, Agent, or Firm*—Allen D. Gutchess, Jr.

[57] ABSTRACT

This invention is an electrically illuminated sign, consisting of a rectangular box containing therein a fluorescent light; a cover for said box in the form of an open frame containing therein interchangeable and interconnectable plates which are stamped into stencil type numbers, letters, or designs, and blank plates which serve as spacers; and a translucent plate located behind said stenciled plates, through which the fluorescent light passes, to illuminate the stenciled characters.

1 Claim, 6 Drawing Figures

INTERCHANGEABLE ILLUMINATED SIGN

This is a continuation of application Ser. No. 188,310 filed Sept. 18, 1980, now abandoned.

This invention relates generally to illuminated signs, and particularly to signs used to indicate house numbers, professional services, street names, etc.

Electrically illuminated signs used at the present time have many disadvantages, such as:

(a) Most such signs have illuminated backgrounds with the letters appearing in silhouette.

(b) Most signs are specifically made for each individual requirement, and when the sign is not further required, it is discarded.

(c) In cases where the letters or numbers are illuminated, instead of the background, these letters do not utilize the full intensity of the provided light; the letters or numbers are not sharply outlined, and in some cases are not recognizable even at comparatively short distances.

It is therefore the object of this invention to provide an electrically illuminated sign in which the numbers or letters are illuminated and appear against a dark background, for a high degree of contrast.

Another object of the invention is to make these letters interchangeable so that basic components of the sign can be used for an unlimited number of changes, with a minimum of cost.

And yet another object of this invention is to provide an illuminated sign in which the letters and numbers are sharply outlined in order to make them easily read at far distances.

All these objects are accomplished in the invention by providing interchangeable letters which are stamped out on black or dark, opaque plates, in the form of sharp-edged stencils, and allowing evenly diffused light to pass through the stencils, and be seen at a far distance.

In describing the invention reference will be made to the attached drawings, in which.

Figure 1:
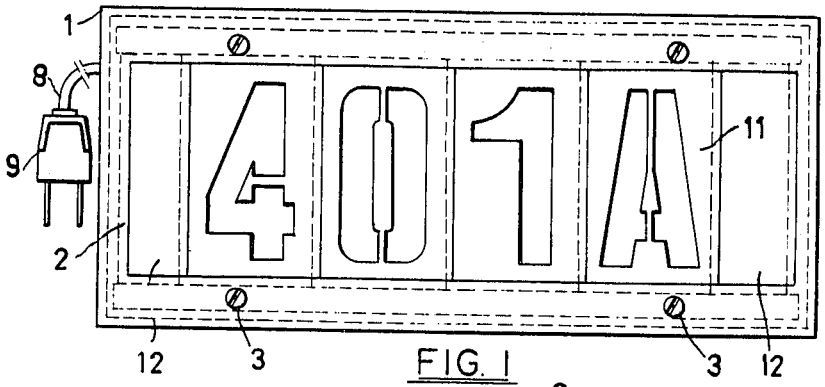
FIG. 1 is the front view of an assembled sign box.
Figure 2:
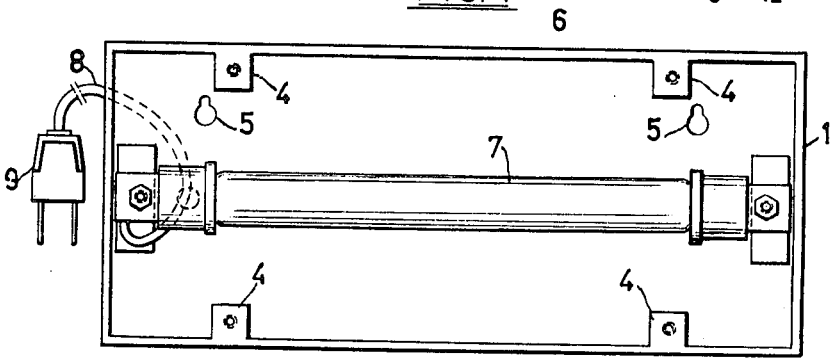
FIG. 2 is a front view of the sign with the front of the box open to show its interior.
Figure 3:
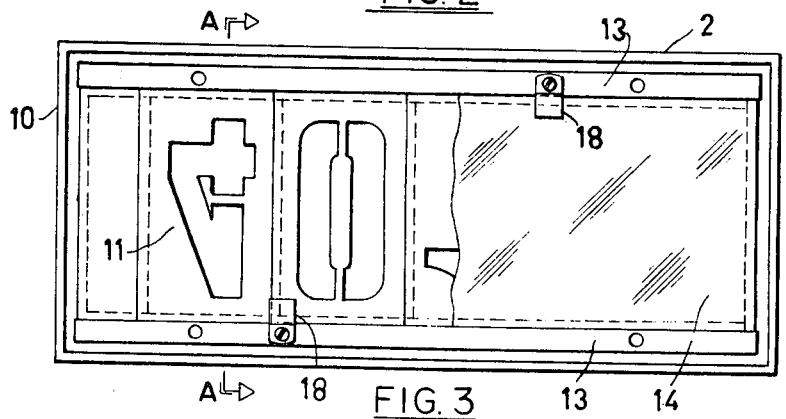
FIG. 3 shows the front view of the frame which covers the front of the sign box.

The invention consists of an open faced rectangular box 1, which is fixed to a frame 2, which is in turn provided with a narrow wall 10 which surrounds the said frame and is at right angles to it. The wall 10 covers the open edge of the box 1, when the sign is assembled, and is fastened to said box by means of screws 3 which screw into lugs 4 provided in the box 1 for that purpose.

The closed back of the box 1 is provided with spaced holes 5, by means of which the sign can be attached to or hung from a wall, post, etc.

Any source of electric light can be provided within the box 1; however, experimentation has shown that a fluorescent light, such as from a fluorescent tube 7, provides the most white light which can be seen at a great distance, at night. The fluorescent tube 7 is wired to an electric cord 8 which extends outside the box 1 and is provided with a plug 9 for attachment to a power source.

The frame 2 is provided on the inside, adjacent to the long sides of the rectangle, with two, spaced, and raised bars 13, to hold between them snugly the rectangular numbers or letters which, for the purpose of this description, are designated by the numeral 11, spacers 12, and a translucent glass or plastic plate 14. Beyond the bars 13, and all around the inner rim, the frame 2 is finished off into a narrow edge or flange 15.

Figure 4:
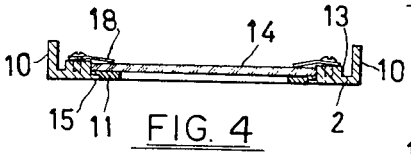
FIG. 4 shows section A—A of FIG. 3.
Figure 5:
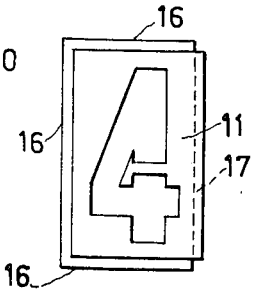
FIG. 5 shows a detail of the interchangeable numbers.
Figure 6:
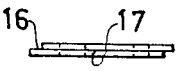
FIG. 6 is an end view of FIG. 5.

The letters, numbers, and any other symbols, or decorative designs, are stamped out, in the form of stencils on thin rectangular plates 11, all of which are the same height, to fit between the bars 13,13, the thin outer edges 15 of the frame 2, and to each other. The widths of the plates 11 are the same for most numbers; however, they may vary in width, as for instance, for "M", "W", "&", and for any other wide design. As shown in FIGS. 5 and 6, each letter 11 is provided with a narrow shoulder, rear flange, or tenon 16 at its upper and lower edges and on the left edge; as viewed from the face of the letter. A similar tenon or front flange 17 is provided on the right side of the letter 11. The tenon 17 is in the opposite location to the tenon 16 so that when two letters are abutting each other, the tenon 16 of one letter fits exactly under the tenon 17 of its adjacent letter. The tenons 16 also fit and contain the thin edge 15 of the frame 2, as shown in FIG. 4.

The installation of the number, or letter plates 11, and the translucent plate 14, consists of first placing the plates 11 and 12 into the frame 2, in their proper order and abutting each other, as shown in FIG. 1, placing the translucent plate 14, on the plates 11, locking the plate 14 in position by means of the clamps 18, then attaching the frame 2 to the box 1 with the screws 3.

For greater contrast between the illuminated numbers or letters, and their background, it is intended to have the plates 11, spacers 12, and the cover 2 colored with a dark color, preferably black.

The above described invention makes it possible to purchase the sign in its knockdown form, because of its simple method or assembly, thereby reducing the purchase cost considerably as compared to specifically designed sign; and the numbers being simply replaceable, the sign can be changed at very little cost.

Having described my invention, What I claim is,

1. A sign illuminated by a fluorescent light comprising, in combination, a rectangular box having an open rectangular front face and having inwardly-extending lugs at the front face to receive fasteners, a rectangular frame of a size to cover the front of the box and having thin flanges extending inwardly around the entire periphery of said frame and defining a rectangular sign opening, said frame having raised bars extending longitudinally thereof on the inner surface thereof and located outwardly of the thin flanges which define longitudinal edges of the sign opening, said raised bars having fastener openings therein, threaded fasteners extending through said fastener openings and being threadedly received in said lugs, a fluorescent light tube located centrally within said box and extending longitudinally thereof, electrical wiring for said light tube located within said box and extending to the outside of said box in the form of an electric cord, a plurality of thin, opaque plates which are rectangular in shape and uniform in height, said plates having transparent indicia in the form of numbers, letters, or designs formed therein, a plurality of spacer blank plates of the same height as said opaque plates serving as spacers between appropriate ones of said thin, opaque plates, as required, the height of all of said plates being substantially equal to the distance between the inner edges of said thin flanges extending longitudinally of the sign opening, each of said plates having thin, rear edge flanges extending beyond the ends of the plate and a rear, thin side flange extending beyond one side edge of the plate, with the opposite side edge of the plate having a front, thin side flange extending beyond the opposite side edge of the plate to engage the rear side flange of an adjacent one of said plates, with said end rear flanges being behind and in contact with the inner surfaces of the longitudinal frame flanges and outer edges of said end flanges being in substantially abutting relationship with edge portions of said raised bars, a light-transmitting plate extending over the backs of said plates and in contact therewith, and clamping means fastened to said raised bars and engaging the back surface of said light-transmitting plate.

* * * * *